United States Patent [19]

Belbel et al.

[11] 4,454,490

[45] Jun. 12, 1984

[54] CONTACTOR WITH THE PROPERTIES OF A CIRCUIT-BREAKER

[76] Inventors: Elie Belbel, 7 Chemin des Concessions, Residence les Lauriers, 92420 Vaucresson; André Haury, 75 Avenue Thiers, 93340 Le Raincy; Louis Féchant, 19 rue Albert ler, 78110 Le Vesinet; Lucien Siffroi, 17 rue des Bourbonnais, 78000 Versailles, all of France

[21] Appl. No.: 268,435

[22] Filed: May 29, 1981

[30] Foreign Application Priority Data

May 30, 1980 [FR] France ..... 80 12086

[51] Int. Cl.[3] ..... H01H 77/10

[52] U.S. Cl. ..... 335/16; 335/147; 335/195

[58] Field of Search ..... 335/16, 195, 38, 147, 335/174

[56] References Cited

U.S. PATENT DOCUMENTS

| | | | |
|---|---|---|---|
| 3,887,888 | 6/1975 | Bayles et al. | 335/195 |
| 3,991,391 | 11/1976 | Wafer | 335/16 |
| 4,013,984 | 3/1977 | Wafer | 335/195 X |
| 4,077,026 | 2/1978 | Slade et al. | 335/195 |

*Primary Examiner*—George Harris

[57] ABSTRACT

An apparatus comprising a plurality of circuit breakers with a rigid contact bridge 16 cooperating with fixed contacts 9, 10 carried respectively by conductors 11, 12, generating repellent forces; the median region 21 of the bridge cooperates with a magnetic structure 37 providing the bridge with compensation forces for the contact pressure when the latter is under a predetermined threshold, above which the bridge is ejected from the fixed contacts. This contactor is advantageously used for the control of power consuming apparatus and protection of their supply lines.

8 Claims, 6 Drawing Figures

CONTACTOR WITH THE PROPERTIES OF A CIRCUIT-BREAKER

BACKGROUND OF THE INVENTION

The present invention relates to a contactor having the properties of a circuit breaker whenever shortcircuit currents are generated, comprising, in a housing, two fixed contacts each of which is carried by one leg of a conductor bent in the shape of a U, a rigid contact bridge carrying a movable contact at both extremities thereof, each of said contacts being adapted to cooperate with a fixed contact in register therewith, said bridge being provided, on both sides of its pivoting median portion, with two opposed arms extending in register with said legs, whereas said median portion is so mounted as to slide in said housing from a position of rest at which said bridge is separated from the fixed contacts by an actuating member connected to an electro-magnet armature, to an operating position at which said bridge is applied against said fixed contacts by a resilient member, said contact bridge being capable of occupying a triggerng position farther from said fixed contacts than said position of rest, whenever electrodynamic repellent forces generated between said arms and legs are above a certain threshold.

THE PRIOR ART

Such a contactor, advantageously used as well for the repeated control of energy-consuming apparatus during its operation in the contactor-mode as for the protection of those lines by which it is fed during its operation in the circuit-breaker mode, can be illustrated, e.g. by French Pat. No. 77 22168 published under No. 2 397 712 in the name of the applicant.

SUMMARY OF THE INVENTION

An apparatus having the general structure such as described above is usually required to possess conflicting properties, insofar as, in the contactor-mode, the currents flowing in the circuit closed by a contactor bridge, have intensities within the range between the operating rated intensity and intensities higher than the latter, observed at the moment of starting or during transient overcharges, for which it is necessary to maintain, and even increase, the contact pressure, whereas, in the circuit-breaker mode, during which highly intense currents start flowing in the bridge, the contacts must open very quickly and deviate from a trajectory providing an efficient limitation of the shortcircuit currents. There exists therefore a specially critical transient phase in the operation of the apparatus, during which the contact pressure must vary very quickly under the action of two counteracting forces, one of which is provided by a contact pressure resilient member, whereas the other is generated in the reverse direction, in view of the generation of repellent electro-dynamic forces. On the other hand, the contact pressure compensating devices must be sufficiently far from the zones of rupture for avoiding the formation of stray arcs, which may prove difficult to obtain whenever special steps are taken in order to improve the efficiency of the electrodynamic forces and, in addition, such compensating forces must be exerted on the contact bridge so as not to modify the balance thereof.

OBJECT OF THE INVENTION

The present invention therefore aims at improving the behaviour of the apparatus in the contactor mode, as well as during the transient phase, and during the current limiting circuit-breaker mode.

According to the present invention, this result is obtained in view of the fact that the contact-bridge median portion cooperates with a magnetizable structure energized by the current flowing through the bridge, said structure being inserted between the actuating member and the bridge and being so directed as to exert on said median portion electro-magnetic forces smaller than said threshold and acting in the direction opposite to the electro-magnetic repellent forces.

Rupture apparatus are already known, provided with a contact-pressure compensating device making use of a magnetizable structure energized by the current flowing in a part carrying a movable contact and fixed in the apparatus housing. However such apparatus of the prior art are not endowed with properties allowing them to operate in the contactor mode and in the circuit-breaker mode, and they have the drawback of being unable to render the compensating forces independent of the contact degree of wear.

BRIEF DESCRIPTION OF THE DRAWINGS

Other features of the present invention, as well as various ways of carrying out the above-mentioned steps, will appear from the following description, given by way of example, with reference to the accompanying drawing, in which.

DESCRIPTION OF THE PREFERRED EMBODIMENT

Figure 1:
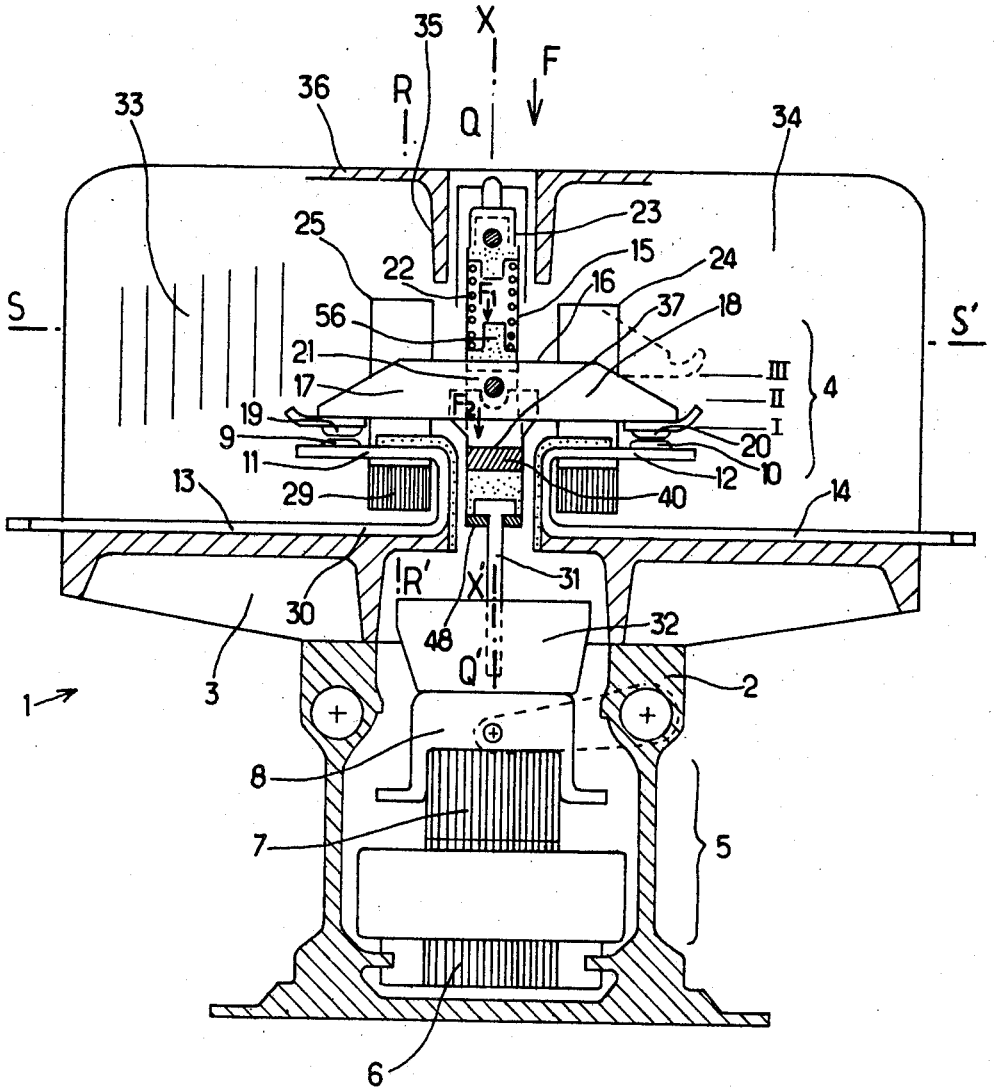
FIG. 1 is an elevation view of a first embodiment of the present invention, with a contact carrier shown sectioned by the plane PP' passing through a contact bridge.

A contactor (1) having the properties of a circuit-breaker, such as shown in FIG. 1, comprises a body (2) constituted e. g. by an extruded metal structure, an insulating housing (3) fixed to said body and adapted to receive several switch sections such as (4), an electromagnet (5) with a fixed base (6) and a movable armature (7) and a coupling member (8) adapted to support said armature and to guide the movements thereof along a direction XX'.

A switch portion (4) is provided mainly with two fixed contact supports (9) and (10), each of which is constituted by a leg (11, 12) respectively of a conductor (13, 14) respectively, bent in the shape of a U each of which is fixed in said housing, a contact-carrier (15) movable along direction XX' between said two conductors and adapted to move from an operating position (I) and a position of rest (II) a rigid contact bridge (16) carried in a median portion (21) by said contact-carrier and provided with two arms (17, 18) parallel with legs (11, 12) respectively, and placed in register therewith, each of which carries a movable contact (19, 20) respectively, adapted to cooperate with the fixed contacts.

Figure 3:
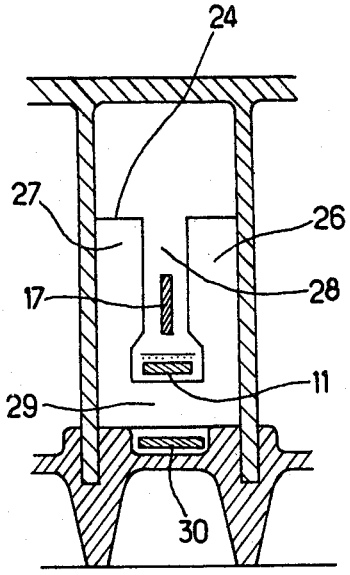
FIG. 3 is a side view of the device according to FIG. 1, sectioned by plane RR' parallel with plane QQ'.
Figure 4:
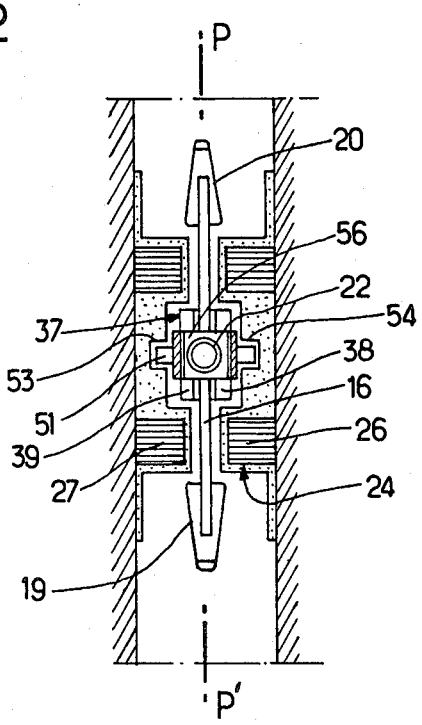
FIG. 4 presents the device according to FIG. 1 seen from above and sectioned by plane SS' indicated in FIG. 1.

A pressure spring (22), mounted in a first extremity (23) of the contact-carrier, exerts on the median portion of contact bridge (16), a force $F_1$, acting in the direction F and adapted to apply the movable contacts against the fixed contacts. Two U-shaped magnetizable parts (24, 25) (see also FIG. 3), each of which is provided with two parallel webs such as (26) and (27), separated by a space (28), and a common cross-piece (29) are associated with each of said arms and legs in such a manner that cross-piece (29) be inserted between leg (11) and a parallel portion (30) of the conductor such as (13), whereas the webs thereof surround said leg and arm (17) of the registering bridge.

A second extremity (31) of the contact-carrier is associated with coupling member (8) through a threshold hooking device, generally designated by reference numeral 32, said hooking device having the property of rendering the coupling member and the contact-carrier integral with each other so long as a force above a certain threshold has not been applied betweem them, on the one hand, and of permitting to establish at will a new connection between said member and said contact-carrier when the latter have been severed from each other, on the other hand. In a manner known per se, arc chambers (33, 34) are associated with each of said pairs of fixed contacts and movable contacts, respectively.

All the members just described, already by themselves endow apparatus (1) with the possibility of operating in the contactor mode, during which the movements of the armature are transferred to the contact-bridge so as to close and open the switch, on the one hand, and in the circuit-breaker mode, on the other hand, during which the electro-dynamic phenomena developed between the arms and legs with the cooperation of magnetizable parts (24, 25), when very high current intensities flow through the loops constituted by said arms and legs, induce, in the contact-bridge, the generation of a force acting in the direction opposite to F and the value of which, higher than the above mentioned threshold, causes said hooking device (32) to open. Holding means are provided for ensuring that the contact-bridge, that has been driven in the direction opposite to F, will remain at a triggering position III, shown in dotted line, so as to prevent the switch from closing again; such means can be mounted in the upper portion (35) of a hollow cover (36) applied aver housing (3), or, preferably, they can form part of the threshold hooking device (32), the latter, very shortly after breaking of the circuit, occupying a position above the one shown in FIG. 1, in view of the automatic deenergization of the electro-magnet at the moment of the generation of current overloads and with the help of means not shown.

When through the switch flow overcurrents that do not induce breaking of the circuit, however the above-mentioned electro-dynamic phenomena occur between the arms and legs and transfer to the contact bridge forces lower than the triggering threshold and capable of compressing spring (22) by decreasing the pressure between the contacts, at a moment when the latter pressure should actually increase.

Figure 2:
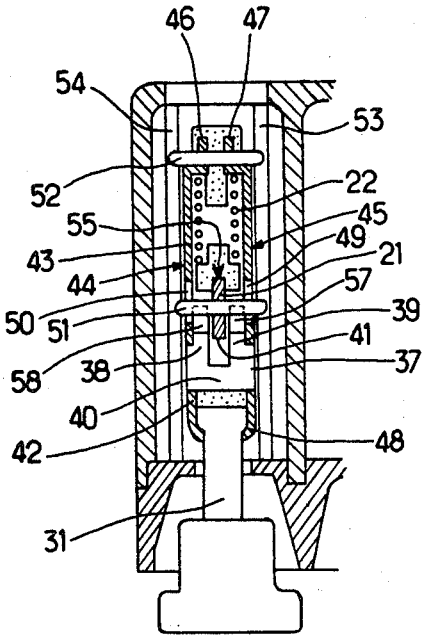
FIG. 2 is a side view of the device according to FIG. 1, sectioned by plane QQ' indicated in FIG. 1.

The pressure compensating device such as shown in FIG. 2 is adapted to improve such as contact pressure during overcurrent operating modes. That device, a preferable though non limitative embodiment is shown in FIG. 2, is constituted mainly by a magnetizable part (37) in the shape of a U, with two parallel webs (38, 39) on both sides of median portion (21) of the contact-bridge and base (40) common to said two webs, mounted between said median portion and the threshold hooking device. That base (40) is secured at a certain distance from the lower edge (41) of the contact-brige whenever the latter rests on the fixed contacts and is integral with the contact-carrier. Whenever a current flows through said bridge, the mutual action of that current and of the magnetic field induced by the latter current into said magnetizable part (38), generates in said bridge a force $F_2$ acting in direction F. That force, the value of which increases with the current intensity, will reach a limit value when that part is saturated; provided the dimensions given to the part are chosen so that that force, for normal service currents, assumes a value capable of partly ensuring the generation of the contact-pressure, contact-pressure spring (22) will be only capable of exerting on the contact-bridge an extra force, smaller than the force that would be necessary in the absence of the compensating device.

Accordingly, the force exerted by such a pressure-spring would be more readily counteracted when the contact-bridge would have to move rapidly in the direction opposite to arrow F during the operation in the circuit-breaker mode.

It is however preferable to provide the contact pressure required for the rated current flow, exclusively by means of compressor-spring (22).

Structurally, magnetizable part (37) is fixed in a lower portion (42) of a non-magnetic metal cage (43) obtained, e.g. by folding a stainless steel strip so as to form two parallel walls (44, 45), a bottom (48) and two upper extremities (46, 47). The bottom of said cage is integral with an extension (31) forming the second extremity of the contact carrier, whereas said walls are provided with two elongated openings, or ports, (49, 50 respectively), parallel with XX' and into which is inserted a cylindrical pin (51) acting as a pivot for the bridge median portion into which it is also inserted. A second pin (52) is also inserted into the extremities (46, 47) of said cage with which it is integral.

The extremities of said two pins protrude outwardly from said walls by a distance sufficient for reaching two grooves (53, 54) made e.g., in the cover along direction XX', and, accordingly, said extremities act as a guide for the contact-carrier constituted by said cage. Spring (22) rests on the upper inner extremities of the cage, on the one hand, and on the upper edge (55) of the contact-carrier, through a pushbutton (56), on the other hand.

The operation of the apparatus in the contactor-mode results from the movements of the armature transferred to the contact-carrier through the threshold coupling (32), it being understood that, in such a case, the latter provides a continuous connection.

Contact pressure spring (22) then exerts the contact initial pressure required for the passage of a rated current.

Whenever overcurrents above said rated current flow through the bridge and up to about 10 times the rated current, the pressure compensating device increases the contact pressure by counteracting the electo-dynamic forces tending to separate the bridge from the fixed contacts. It will be noted that, for a given current, such compensating forces depend very little on the contact degree of wear, in view of the shape and arrangement of part (37) with respect to the contact bridge.

As soon as the current has reached a value above said overcurrent, the electro-dynamic repellent forces prevail over the forces exerted by the spring and by the compensating device, which causes the hooking device (32) to open and, therefore, releases lower extremity (31). Accordingly, the contact-carrier is quickly propelled upwards and it drives therewith the contact bridge, the latter being submitted to a percussion force communicated to pin (51) e.g., by part (37). To that end can be provided two cuts (57,58) made in webs (39,38), in which is inserted pin (51) with a certain actual clearance in order that the percussion be achieved by the bottoms of said cuts.

Figure 5:
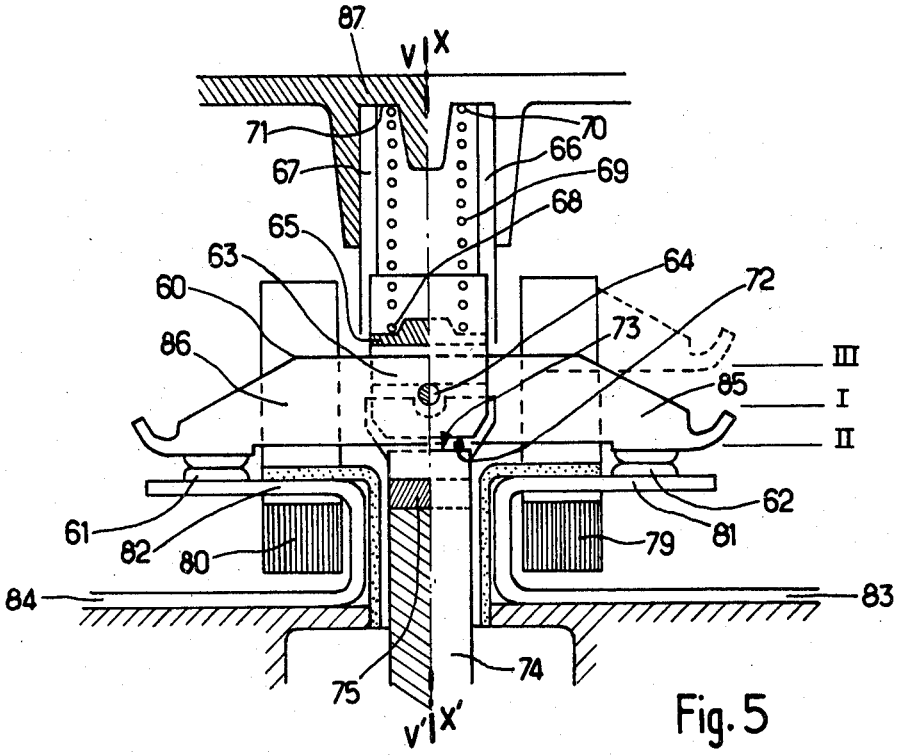
FIG. 5 is an elevation view of a second embodiment of the present invention, sectioned by plane TT' and in which the contact bridge is not carried by a contact-carrier connected to the actuating member.
Figure 6:
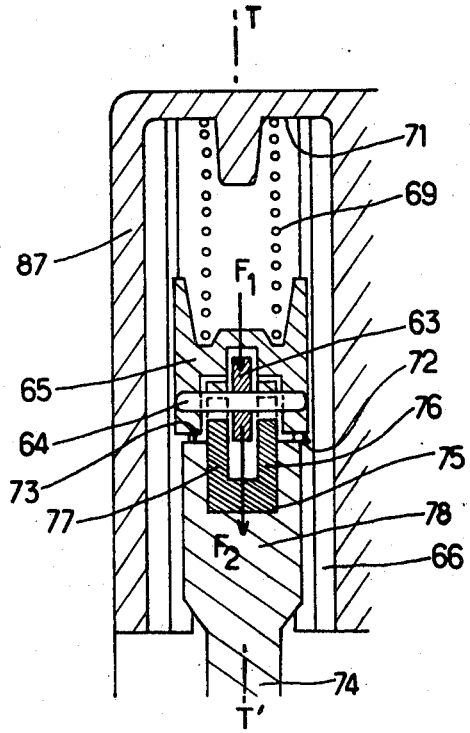
FIG. 6 is a side view of said second embodiment of the invention, sectioned by plane VV' indicated in FIG. 5.

In the embodiment of the present invention illustrated in FIGS. 5 and 6, a contact bridge (60) cooperates with two fixed contacts (61, 62) similar to the previous ones. Here again, the contact bridge pivots, in the median portion (63) thereof, about a pin (64), but the latter is integral with a contact-carrier (65), of reduced dimensions, guided along axis XX' along slides (66,67) of the housing and submitted to the resilient action of a first extremity (68) of a compression spring (69), the second extremity (70) of which rests on an upper bottom (71) of housing (87). The contact bridge is thus submitted to the resilient action of that spring, tending to apply it against the fixed contacts and providing an initial contact pressure.

A lower surface (72) of the contact carrier is directed towards an upper surface (73) forming part of an actuating member (74) movable along XX' in view of its continuous association with an electro-magnet armature (not shown). At position II shown in FIGS. 5 and 6, the electromagnet is energized and, the fixed contacts and the movable contacts being closed, a slide spacing is left between surfaces (72) and (73); when the electro-magnet is deenergized, the actuating member is moved towards the top of the figure and raises the contact-carrier so as to bring it to position I of rest and cause the fixed contacts and the movable contacts to open.

A U-shaped magnetizable part (75) similar to the previous one (see FIG. 6) and provided, accordingly, with two legs (76, 77) surrounding median portion (63) of the bridge, is fixed to the upper extremity (78) of actuating member (74), so that, when the latter is maintained at the position represented by the electro-magnet armature, a current flowing through the bridge induces, as in the previous case, the attraction of the bridge median portion towards the bottom of part (75), which generates an increase of the contact pressure in the case of overcurrents.

Here again, two U-shaped magnetic parts (79, 80) are used around legs (81, 82) of the fixed contact supports (83, 84) and of arms (85, 86) of the bridge, for improving the efficiency of the repellent electro-dynamic forces whenever short-circuit currents are generated. It is to be noted, in the latter embodiment, that the weight of the contact-carrier is smaller than in the first embodiment, so that the contact bridge can be severed from the fixed contact more quickly and the current limitation effect will be improved. Hooking means (not shown) permit to maintain the contact bridge at the triggering position III, shown in dotted line, whenever the apparatus has broken the circuit; as a general rule, position III will be farther from the fixed contacts than the one corresponding to the position I of rest of the bridge.

What is claimed is:

1. A contactor having the properties of a circuit breaker whenever short-circuit currents are generated, comprising, in a housing, two fixed contacts each of which is carried by one leg of a contact support bent in the shape of a U, a rigid contact bridge carrying a movable contact at both extremities thereof, each of said contacts being adapted to cooperate with a fixed contact in register therewith, said bridge being provided, on both sides of its median portion, with two opposed arms extending in register with said legs, whereas said median portion is so mounted as to slide in said housing from a position of rest at which said bridge is separated from the fixed contacts by an actuating member connected to an electro-magnet armature, and operating position at which said bridge is applied against said fixed contacts by a resilient member, said contact bridge being capable of occupying a triggering position farther from said fixed contacts than said position of rest, whenever electrodynamic repellent forces generated between said arms and legs are above a certain threshold, characterized in that the median portion (21, 63) of the contact bridge (16, 60 respectively) cooperates with a magnetizable structure (37, 75 respectively) energized by the current flowing through the bridge, said structure being inserted between the actuating member (31, 74 respectively) and said median portion and being directed so as to apply on said median portion compensating electro-magnetic forces $F_2$ lower than said threshold and acting in the direction opposite to the electro-dynamic repellent forces, on the one hand, and in the same direction as the initial contact pressure forces $F_1$ transferred by the resilient member (22, 69 respectively), on the other hand.

2. A contactor according to claim 1 characterized in that the initial contact-pressure forces $F_1$ are sufficient for providing the contact pressure when rated service currents flow through the contact bridge and in that the compensating forces $F_2$ reach a certain limit when through the contact bridge flow current the value of which is about ten times that of said service current.

3. A contactor according to any one of claims 1 and 2, characterized in that said magnetizable structure is consitituted by a U-shaped part (37, 75) provided with two parallel webs (38, 39 and 76, 77 respectively), between which said median portion (21, 63 respectively) is partly engaged and cross-piece (43) directed towards said actuating member (31, 74 respectively).

4. A contactor according to claim 3, characterized in that said U-shaped part is mounted in a contact-carrier (43) connected to the armature (7) of an electromagnet through a threshold coupling device (32) and in that the initial contact pressure forces are provided by a sring (22) mounted in said contactor between said median portion (21) and an extremity (46, 47) of said contact-carrier opposed to said coupling device.

5. A contactor according to claim 4, characterized in that said contact-carrier (43) is constituted by a non-magnetic metal cage, between two walls (44, 45) of which is fixed said U-shaped part (37).

6. A contactor according to claim 5, characterized in that said contact-carrier (43) is guided in housing (36) by two cylindrical pins (51, 52) passing through said two walls (44, 45), a first pin (51), acting as pivot for said median portion (21) being capable of moving in said contact-carrier at right angles to the actuating axis XX'.

7. A contactor according to claim 3, characterized in that said median portion of contact bridge (60) is mounted in contact-carrier (65) adapted to slide in the housing or cover (87) and situated between an initial contact pressure spring (69) resting on a bottom (71) of said housing and an extremity (78) of an actuating member (74) carrying said U-shaped part (75) and not connected to said contact-carrier.

8. A contactor according to claim 1, characterized in that said two U-shaped magnetizable parts (24, 25 and 79, 80 respectively) provided with parallel webs between which are placed the opposed arms of the bridge and the corresponding fixed contact legs, are mounted in the housing (3, 36) in order to increase the electrodynamic repellent forces.

* * * * *

UNITED STATES PATENT AND TRADEMARK OFFICE

CERTIFICATE OF CORRECTION

PATENT NO. : 4,454,490

DATED : June 12, 1984

INVENTOR(S) : Elie Belbel et al.

It is certified that error appears in the above-identified patent and that said Letters Patent are hereby corrected as shown below:

On the title page insert:

-- (73) Assignee: La Telemecanique Electrique

Nanterre, France --.

Signed and Sealed this

*Twenty-sixth* Day of *February 1985*

[SEAL]

*Attest:*

DONALD J. QUIGG

*Attesting Officer* *Acting Commissioner of Patents and Trademarks*